US005759641A

United States Patent [19]

Dimitrienko et al.

[11] Patent Number: 5,759,641

[45] Date of Patent: Jun. 2, 1998

[54] METHOD OF APPLYING STRENGTHENING COATINGS TO METALLIC OR METAL-CONTAINING SURFACES

[76] Inventors: Ludmila Nikolaevna Dimitrienko, Pos. Udelnaia Zeliony Gorodok. D. 14, kv. 14, 140140, Moscowskaia Obl., Russian Federation; Maria Alexandrovna Zelenskaia, Ul. Lusinovskaia, D. 12, kv. 20, 1130983, Moskwa, Russian Federation; Evgeny Dmitrievich Izotov, Pos. Ilinsky, Ul. Oparinskaia, D. 72 B, kv. 12, 140120, Moskowskaia Obl., Russian Federation

[21] Appl. No.: 648,507

[22] Filed: May 15, 1996

[51] Int. Cl.[6] ..... B05D 3/00

[52] U.S. Cl. ..... 427/556; 427/309; 427/327; 427/376.1; 427/383.3; 427/405; 427/554; 427/555; 427/559; 427/597

[58] Field of Search ..... 427/555, 556, 427/559, 597, 309, 328, 376.1, 383.3, 405, 554

[56] References Cited

U.S. PATENT DOCUMENTS 3,952,180 4/1976 Gnanamuthu ..... 219/121 LM 4,832,983 5/1989 Nagatomi et al. ..... 427/81

OTHER PUBLICATIONS

Laser Processing of Plasma–Sprayed NiCr Coatings, H. Bhat et al, Laser in Material Processing, 1983, pp. 176–183 (no month avail.).

*Primary Examiner*—Bernard Pianalto
*Attorney, Agent, or Firm*—Felfe & Lynch

[57] ABSTRACT

A method of applying strengthening coatings to metallic or metal-containing surfaces is provided in which the surface (2) to which a strengthening coating is to be applied is first subjected to activation, then at least one strengthening coating layer (1) is applied to the surface thus prepared. Said layer is treated with a laser beam (3) having a diameter (d) ranging from 0.2 mm to half the diameter (d) of the laser beam (3) entering into focusing element (5), with a power of at least 0.5 kW, with a rate of relative travel (A) of the surface being treated (2) and the laser beam (3) of at least 50 mm/min, the distance (L) between the focal plane (f) of the focusing element (5) to the surface being treated (2) being less than or equal to half the focal distance (F).

20 Claims, 4 Drawing Sheets

METHOD OF APPLYING STRENGTHENING COATINGS TO METALLIC OR METAL-CONTAINING SURFACES

TECHNICAL FIELD

The present invention relates to the surface treatment of metals, more particularly to applying strengthening coatings, and still more specifically to methods of applying strengthening coatings to metal or metal-containing surfaces.

The invention can be used in the aircraft industry, mechanical engineering, engine building, machine-tool engineering, in the manufacture of other mechanisms and machines operating under especially serve conditions of enhanced loads, vibrations, high temperatures, in the presence of aggressive and corrosive media, etc., as well as in the manufacture and restoration of parts, where it is necessary to preclude the appearance of or eliminate surface injuries and improve the service characteristics, such as wear-resistance, corrosion-resistance, high-temperature strength, heat-resistance, etc.

BACKGROUND ART

At present, one of the important aspects of the operability of many machine parts is the vulnerability to surface injuries resulting from mechanical effects, wear, corrosion, etc. To reduce or eliminate completely such injuries, machine parts are subjected to surface strengthening, and the worn-out surfaces of machine parts are restored by different methods. However, in some cases, because of the complicated geometry of the surface and profile of machine parts, it is very difficult ensure high-quality restoration thereof.

In the field of surface treatment of metallic materials, at present methods of surface strengthening of these materials with the use of a laser beam have become widespread. These methods include different processes of surface quenching, surfacing, cladding, gas-phase doping, etc. These methods consist mainly in that the surface of the machine part to be strengthened is acted upon with a laser beam, and/or a doping gas or material is introduced into the laser beam zone.

However, quenching and gas-phase doping fail to ensure an appreciable surface strengthening effect, because surface strengthening occurs by way of changes in the structural and phase state of the machine part material. Therefore, these kinds of hardening are employed mainly for quench-hardenable steels rather than for a wide range of materials, and do not enable radical changes in the properties of the machine part surface. Moreover, these methods make almost no change in the physical dimensions of the worn-out machine part and are inapplicable in restoring thereof.

It is most expedient to apply a strengthening material possessing special properties, different from those of the machine part material (for instance, a corrosion-resistant, high-temperature-resistant, heat-resistant, wear-resistant, and the like material) to the surface of a support. The strengthening material can be used in the form of wire, a plate, a rod, a powder, etc.

Numerous methods are known in the art for applying a strengthening material to metallic surfaces with the use of laser radiation, for example, cladding (see U.S. Pat. No. 3,952,180).

Said method of cladding comprises:

application of one material or a plurality of materials tightly to the metallic machine part;

fusion of said material(s) with a laser beam.

The laser beam power is approximately 1–20 kW, the rate of treatment is approximately 12.5–125 cm/min, and the laser beam diameter is about 2.5 mm. The surfacing material is a rod, a ribbon, or wire of cobalt, iron, nickel, or other alloys.

However, the above method cannot be used for applying strengthening coatings to surfaces having an intricate profile, because it is very difficult to manufacture a plate, wire, or a rod which will faithfully copy the surface being hardened and to provide intimate contact of said plate, wire or rod with the support, whereas an inadequate contact of the strengthening material with the support results in incomplete fusion and other defects.

Furthermore, in some cases it is necessary to provide a surface comprising a combination of hardened and non-hardened zones possessing properties other than the properties of the support. It proves technologically very difficult and expensive to provide such a surface by the method set forth above.

Known in the art is a method of laser surfacing (see U.S. Pat. No. 4,832,983) comprising application of a mixture of powdered materials to the machine part surface and fusion of said mixture with a scanning laser beam across the applied powdered material.

In that case the laser beam is reflected from a focusing mirror, comes to an oscillating rotatable mirror, and, on reflecting therefrom, the laser beam falls onto the surface being treated and fuses the powdered material poured thereon.

This method, however, does not make it possible to harden surfaces with an intricate profile either, because the powdered material may always be entrained from the melting zone when the support is protected from oxidation with a stream of an inert gas, whereas, in the case where the surface being hardened has a small size, it is very difficult to ensure that the height of the powdered material applied to said surface should be the same and that said material should be retained thereon.

Entrainment of the powder from the zone of laser action can be precluded, for instance, by blowing the powder directly into the zone of laser action. In such a case the powder melts immediately and forms a hardening surfacing layer.

However, when restoring the surface with varying physical parameters (e.g., turbine or compressor blades and the like), for adequate fusion of the surfacing material with the machine part it is necessary to control the amount of specific energy absorbed by the unit of the machine part surface so as to avoid possible overheating and deformation of said part. As the amount of the specific energy varies, it is necessary to vary the consumption of the powder accordingly. Practically, this cannot be achieved, and, in addition, this will inevitably lead to changes in the size of the buildup layer.

This method also fails to provide on the machine part surface a combination of strengthened and nonstrengthened zones different from the support material, which appreciably increase the wear-resistance of large surfaces subject to mutual friction.

Also known is a method of laser treatment of coatings produced by high-temperature deposition from the gas phase (H. Bat, H. Herman, and R. J. Coyle, "Laser Processing of Plasma-Sprayed Ni—Cr Coating" // Laser in Material Processing, 1983, pp. 176–183), which consists in that the support surface to which the strengthening coating will be applied is prepared by roughening said surface, then a coating is applied by plasma spraying to the surface of the prepared machine part, and after that the coating is processed with laser radiation.

The laser beam fuses the coating and eliminates pores present therein. This results in an appreciable increase of the corrosion resistance of the machine part surface. The power of the laser beam is about 200–300 W; the width of fused zones is about 20–25 μm.

However, the applicability of this method is limited by the small power of the laser beam, which restricts the use of coatings with a high melting temperature or having a sufficiently large thickness, and by small size of the fused zone, as well as by the low efficiency, because the whole surface cannot be fused in one pass, and one has to subject the non-fused surface to the repeated action of the laser beam.

Furthermore, fusion of the coating with the laser beam yields nonuniform strengthened zones because of the nonuniform energy distribution in the spot; as a result, the quality of the processing is impaired.

DISCLOSURE OF THE INVENTION

The main object of the present invention is to enhance the service properties of a machine part surface strengthened in conformity with the method claimed herein.

Another no less important object of the present invention is to provide a possibility of restoring the operability of machine parts by eliminating surface injuries, and also of restoring the physical dimensions of these machine parts.

Yet another important object of the present invention is to provide a method which will make it possible, whenever necessary, to increase purposefully the physical dimensions of the machine part surface being strengthened.

A further important object of the present invention is to provide a method of applying strengthening coatings to metallic or metal-containing surfaces which allows an appreciable increase in the wear-resistance of the surface of machine parts operating under the conditions of elevated contact loads and vibrations.

A still further important object of the present invention is to provide a method of applying strengthening coatings to metallic or metal-containing surfaces which ensures corrosion resistance of the machine part surfaces in the presence of aggressive corrosive media.

Yet another object of the present invention is to provide a method of applying strengthening coatings which makes it possible to increase appreciably the heat-resistance and high-temperature strength by doping and changing the structure of the machine part surface.

Yet another object of the present invention is to provide a method of applying strengthening coatings to metallic or metal-containing surfaces which makes it possible to obtain coatings with special discrete properties on different portions of the machine part surface, depending on discrete loads and service purposes, e.g., with an enhanced strength of the coating adhesion to the machine part surface in the portions subject to the effect of high loads.

A still further object of the present invention is to provide a method of applying strengthening coatings to metallic or metal-containing surfaces which makes it possible to achieve coatings with properties varying over the thickness thereof, e.g., corrosion resistance of the strengthening coating layer with a view to reducing residual stresses in the surface layer of the machine part.

One more object of the present invention is to provide a method of applying strengthening coatings which would make it possible to achieve multilayer coatings from a homogeneous and/or heterogeneous metallic or metal-containing material for producing strengthening coatings possessing special properties, e.g., with a view to ensuring electrochemical compatibility of the lowermost layer of the coating with the material of the machine part to which said layer of the coating is applied, along with the wear-resistance of the uppermost layer of the strengthening coating.

These and other objects of the present invention are accomplished by a method of applying strengthening coatings to metallic or metal-containing surfaces, in which the surface of the machine part to which a strengthening coating will be applied is first subjected to activation; then a layer of the strengthening coating is applied to the machine part surface thus prepared by any of the methods known in the art: high-temperature deposition from the gas phase, electroplating, etc.; thereafter, the strengthening coating layer thus obtained is processed with a laser beam; according to the invention, at least one strengthening coating layer is applied to the surface, treatment of said layer is effected with a focused laser beam with a distance from the focal plane of the focusing element to the surface under treatment being less than or equal to half the focal distance, with a diameter equal to approximately from 0.2 mm to half the diameter of the beam entering into the focusing element, with the laser beam power of at least 0.5 kW, and with a velocity of relative travel of the surface being treated and the laser beam of at least 50 mm/min.

This makes it possible to fuse the coating layer of different thicknesses from different metallic or metal-containing materials and to improve appreciably the quality of the strengthening coating as such, e.g., to reduce its porosity, increase its hardness, wear-resistance, corrosion-resistance, etc.

The layer of the strengthening coating can be processed until complete fusion thereof over the thickness.

This ensures a reduction of porosity throughout the thickness of the strengthening coating and changes in the structure thereof.

The layer of the strengthening coating can be processed until partial fusion thereof over the thickness.

This makes it possible to change the properties of the strengthening coating, e.g., to "heal" pores on the surface, to reduce the surface roughness, and, at the same time, to change the structure thereof.

It is expedient that the time of the laser beam interaction with the layer of the strengthening coating should be set at each point thereof within the range of 0.3 to 0.8 of the time of interaction of the laser beam with the layer of the strengthening coating at each point to cause complete fusion thereof over the thickness.

This ensures partial fusion of the strengthening coating layer over the thickness and the provision of special prescribed surface properties, e.g., an enhanced wear-resistance.

The strengthening coating layer can be processed until the machine part becomes sub-fused.

This enables an appreciable increase in the strength of adhesion between the coating and the support.

It is expedient that the time of the laser beam interaction with the layer of the strengthening coating at each point thereof should be set to be at least 1.1 of the time of interaction of the laser beam with the layer of the strengthening coating at each point to cause complete fusion thereof over the thickness.

This ensures sub-fusion of the machine part along with an extremely high strength and quality of the strengthening coating.

The treatment of the strengthening coating can be effected at least within a portion of said coating.

This enables an improvement in the properties of the coating on the surface thereof.

The strengthening coating can be treated along the periphery of the surface of said coating.

This provides an appreciable increase in the strength of adhesion between the strengthening coating layer and the machine part, without changing the physicochemical properties of the surface of said coating.

The layer of the strengthening coating can be treated along and/or across the surface thereof.

This provides a combination of fused and non-fused portions of the coating layer, said combination leading to an increase in the wear-resistance of its surface and relaxation of residual stresses.

It is expedient that the strengthening coating layer be treated with a scanning laser beam.

This provides a uniform energy distribution in the spot of the laser beam and a uniform heating at each point of the strengthening coating layer, as well as an increase of the treatment zone and of the process efficiency.

It is expedient that the scanning frequency of the laser beam over the surface of the strengthening surface layer should be set equal to at least 40 Hz.

This enables the provision of a high scanning rate and a high quality of fusion of the strengthening coating layer without non-fused zones, with the maximum possible time of interaction of the laser beam with the surface of the strengthening coating.

It is expedient that the scanning amplitude of the laser beam over the surface of the strengthening coating layer should be chosen based on the shape and physical dimensions of the machine part surface with the strengthening surface layer.

This makes it possible to allow for the specific features of the machine part design and to improve the quality of treatment.

It is expedient that the scanning amplitude of the laser beam over the surface of the strengthening coating layer be chosen to be equal to at least half the diameter of said beam.

Thereby, the zone of laser action and the dimensions of the fused coating layer can be increased. In addition, the energy distribution in the zone of laser action becomes more uniform.

It is expedient that scanning of the laser beam over the surface of the strengthening coating layer should be effected along a line or along a planar physical figure.

This makes it possible to obtain different versions of energy distribution in the zone of laser action and to allow for the geometry of the machine part with the strengthening coating.

The strengthening coating can be applied prior to the laser treatment in layers of homogeneous and/or heterogeneous materials.

This will make it possible to obtain a strengthening coating with prescribed properties on the surface of the machine part.

Each applied layer of the strengthening coating can be successively treated with a laser beam.

This will make it possible to increase the strength of adhesion between the layers of the strengthening coating and to obtain thick coatings.

It is possible to treat with the laser beam all the applied layers of the strengthening coating simultaneously.

This makes it possible to increase the strength of adhesion between the layers of the strengthening coating and the machine part surface and to achieve special properties on said surface.

BRIEF DESCRIPTION OF THE DRAWINGS

The method herein of applying strengthening coatings to metallic or metal-containing surfaces will be better understood from a description of particular examples of its embodiment, to be read in conjunction with the accompanying drawings, in which.

BEST METHOD OF CARRYING OUT THE INVENTION

Figures 1, 2:
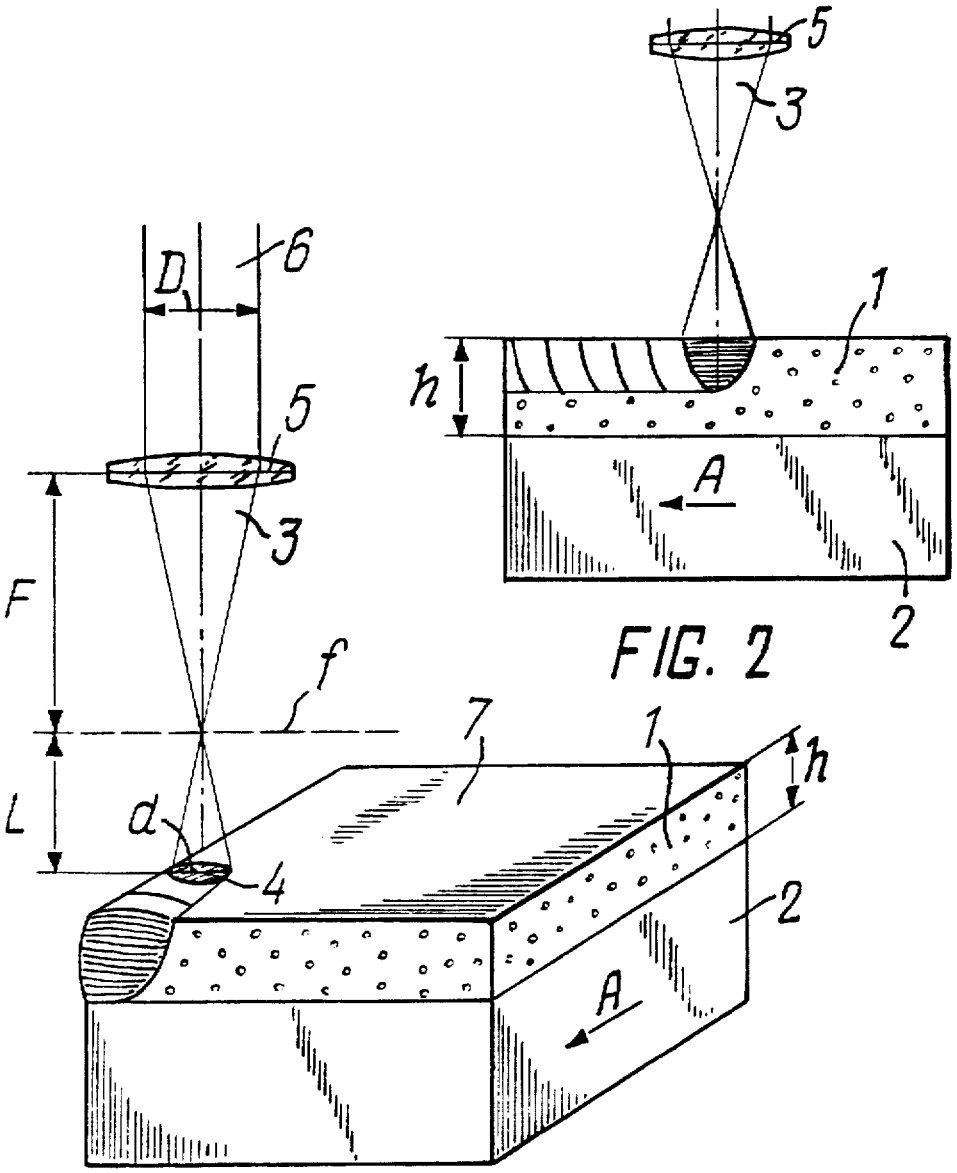
FIG. 1 shows diagrammatically laser treatment of the strengthening coating layer until complete fusion thereof over the thickness, according to the method of the invention.
FIG. 2 shows diagrammatically laser treatment of the strengthening coating layer until partial fusion thereof over the thickness, according to the method of the invention.

The herein-proposed method of applying a strengthening coating layer 1 (FIG. 1) to metallic or metal-containing surfaces 2 comprises the following operations. A machine part surface 2 is first prepared for applying a strengthening coating layer 1 thereto by activating thereof, said activation consisting in that the machine part surface 2 is treated by surface plastic deformation and/or by applying surfactants thereto, and/or by electrodeposition of a low-melting coating, a thermosetting coating, or by any other well-known method. Then at least one layer 1 of the strengthening coating is applied to said prepared surface 2, using the plasma-spraying, detonation, flame spraying, electrodeposition, or any other known method; after that the resulting layer 1 of the strengthening coating is treated with a focused laser beam 3 by acting therewith on the machine part surface 2 moving in a direction indicated by arrow A. We have established experimentally that it is expedient that the diameter d of the laser beam 3 in the zone 4 of treatment of the surface of the layer 1 should be chosen within a range of from approximately 0.2 mm to half the diameter D of the beam 3 entering into focusing element 5. The diameter d of the laser beam 3, equal to approximately 0.2 mm is the optically minimum possible size of the diameter d of the beam 3 in the zone 4 of treatment of the surface of the layer 1 of the strengthening coating, when said beam 3 is focused by the focusing element 5. In laser treatment of the surface of the layer 1 with the focused beam 3 having the diameter d in the zone 4 of treatment, more than half of unfocused beam 6 leads to nonuniform energetic action on the layer 1 of the strengthening coating. The power of the laser beam 3 should be set equal to at least 0.5 kW, because at a smaller power of the laser beam 3 there occurs only heating of the layer 1 of the coating without any structural changes thereof. The maximum power of the beam 3 depends on the potentialities of the laser generator (not shown in the Figure) and on the physicochemical properties of the strengthening coating and of the surface 2 of the machine part; the potentialities of the laser generator, in their turn, depend on its design. The physicochemical properties of the strengthening coating and of the surface 2 of the machine part, such as the melting temperature, heat conductivity, thickness of the coating, etc., determine the laser power necessary for obtaining the required properties on the surface 2 of the machine part. The rate of travel of the layer 1 of the strengthening coating with respect to the laser beam 3 should be set equal to at least 50 mm/min, because lowering of this rate to less than 50 mm/min leads to overheating of the coating 1 and to a higher level of residual stresses therein, as well as to possible stripping thereof later on. The distance L from the focal plane f of the focusing element 5 to the zone 4 of treatment of the layer 1 of the coating can be either equal to or smaller than half (½) of the focal distance F of the focusing element 5. An increase in the distance L from the focal plane f to the zone 4 of treatment of the layer 1 of the coating to more than half the focal distance F of the focusing element 5 leads to nonuniform energy distribution in the zone 4 of laser treatment of the layer 1 of the coating, and, correspondingly, to nonuniform fusion of the layer 1 of the coating over its thickness h.

The layer 1 of the strengthening coating can be treated until its complete fusion over the thickness h (FIG. 1).

The layer 1 (FIG. 2) of the strengthening coating can be treated until partial fusion thereof over the thickness h. This is necessary, when special properties should be obtained on the surface of the layer, e.g., when it is necessary to achieve an increase in the corrosion resistance; to decrease the heat input to the upper layer of the machine part surface with a view to preclude warping of said machine part; to preclude weakening of the surface layer of the machine part, if the coating is applied to the machine part which has been subjected to final heat treatment; to reduce the level of residual stresses. The time of interaction of the laser beam 3 with the strengthening coating at each point of its surface should be set in the range of from about 0.3 to about 0.8 of the time of interaction of the laser beam 3 with the strengthening coating at each point of the surface thereof in the case of its complete fusion through over the thickness h. If the time of interaction of the laser beam 3 with the strengthening coating at each point of the surface thereof is less than 0.3 (of the time of interaction of the laser beam 3 in the case of its complete fusion over the thickness h), only heating of the layer 1 of the strengthening coating occurs without any structural changes thereof, whereas, if the time of interaction exceeds 0.8, in some places, due to the non-homogeneity of the layer 1 of the coating, there complete fusion thereof over the thickness h, takes place this being undesirable in many cases, e.g., when the level of residual stresses in the layer 1 of the coating is high, since said residual stresses lead to stripping of the layer 1 of the coating in the case of complete fusion thereof.

Figure 3:
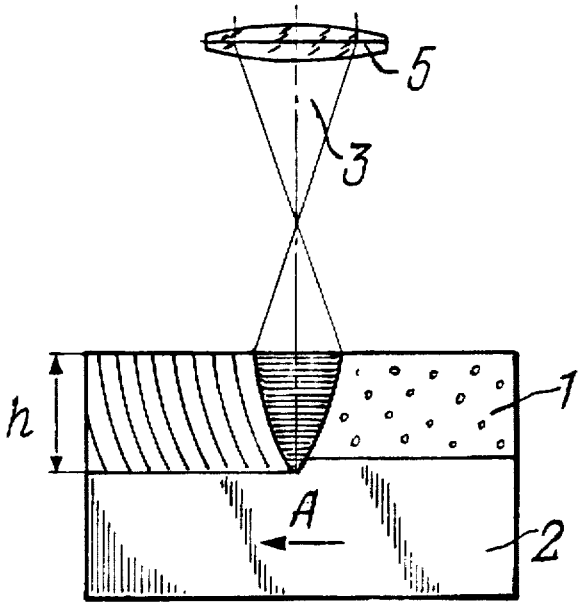
FIG. 3 shows diagrammatically laser treatment of the strengthening coating layer until sub-fusion thereof over the thickness, according to the method of the invention.

The layer 1 (FIG. 3) of the strengthening coating can be treated until sub-fusion of the surface 2 of the machine part to whose surface said layer 1 is to be applied. In such a case the time of interaction of the laser beam 3 with the strengthening coating at each point thereof should be set equal to approximately 1.1 of the time of interaction of the laser beam 3 with said coating at each point of its surface in the case of complete fusion of the layer 1 of said coating over the thickness h. If the time of interaction of the laser beam 3 with the strengthening coating at each point of its surface is less than 1.1, in some places the fusion of the layer 1 of the coating with the surface 2 of the machine part to which it is applied may be incomplete due to the non-homogeneity of the coating. This impairs the properties of the layer 1 of the coating treated with the laser beam 3, e.g., lowers the strength of its adhesion to the machine part surface and, later on, causes stripping of the strengthening coating during the machine part operation under high contact loads.

Figure 4:
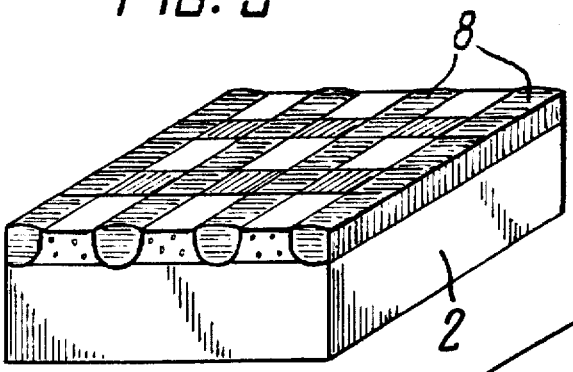
FIG. 4 shows diagrammatically laser treatment of the coating along and across the surface of the strengthening coating layer, according to the method of the invention.

The laser treatment can be effected at least on a portion of the surface of the layer 1 (FIG. 4) of the strengthening coating, either along the periphery or along and/or across said layer, when it is necessary to increase the wear-resistance of the coating stepwise or to raise the strength of adhesion not all over the surface thereof but in the places of elevated loads. Such a treatment makes it possible to obtain additional special properties of the surface of the layer 1 of the strengthening coating, e.g., an enhanced wear-resistance, corrosion resistance of the entire strengthening coating or of a part thereof, etc.

Figure 5:
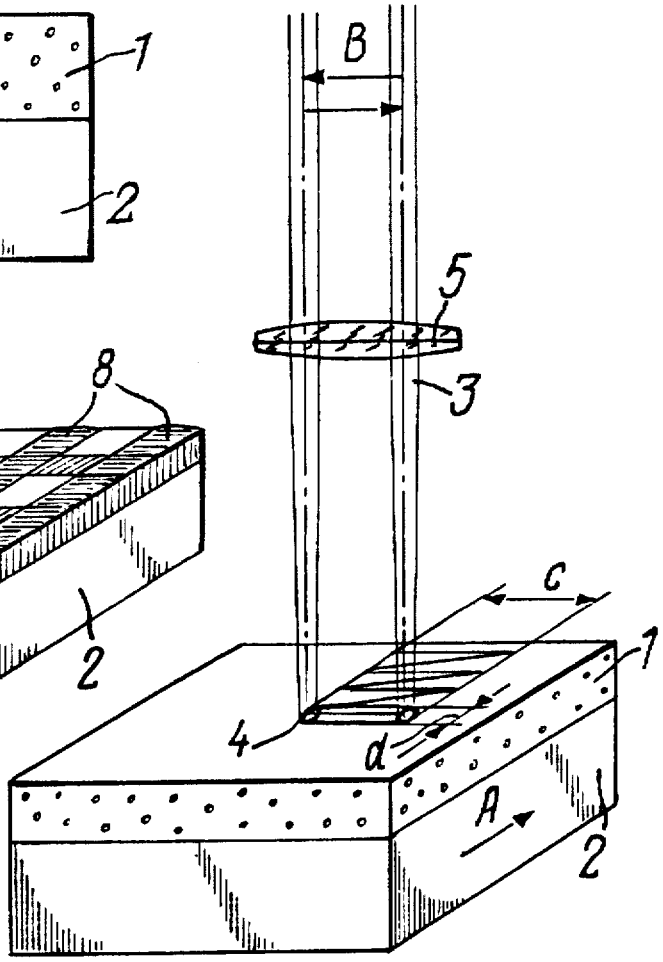
FIG. 5 shows diagrammatically laser treatment of the strengthening coating layer with a scanning laser beam, according to the method of the invention.
Figure 8:
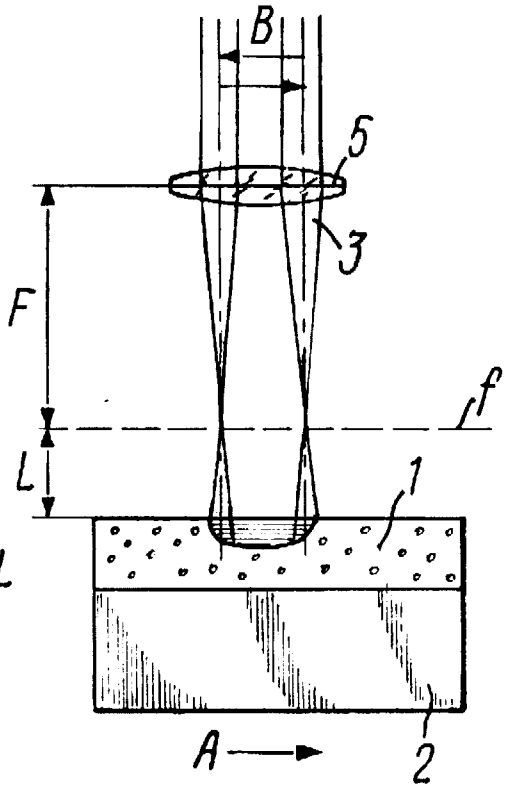
FIG. 8 shows diagrammatically laser treatment of the strengthening coating layer (the focal plane being disposed above the surface of said coating layer), according to the method of the invention.
Figure 7:
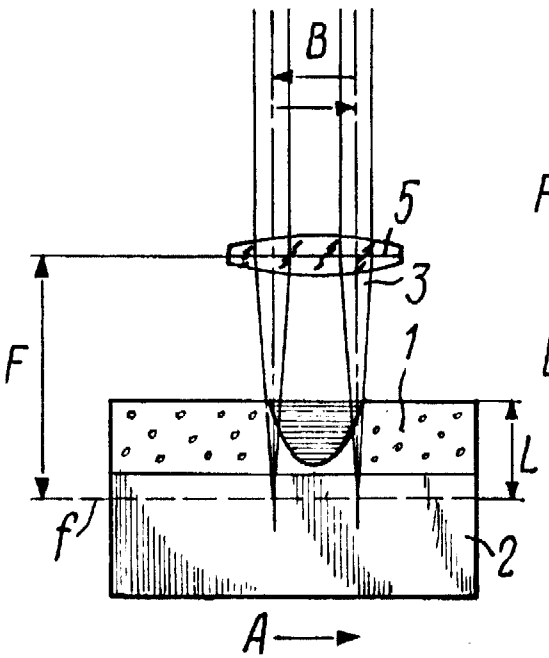
FIG. 7 shows diagrammatically laser treatment of the strengthening coating layer (the focal plane being disposed below the surface of said coating layer), according to the method of the invention.
Figure 6:
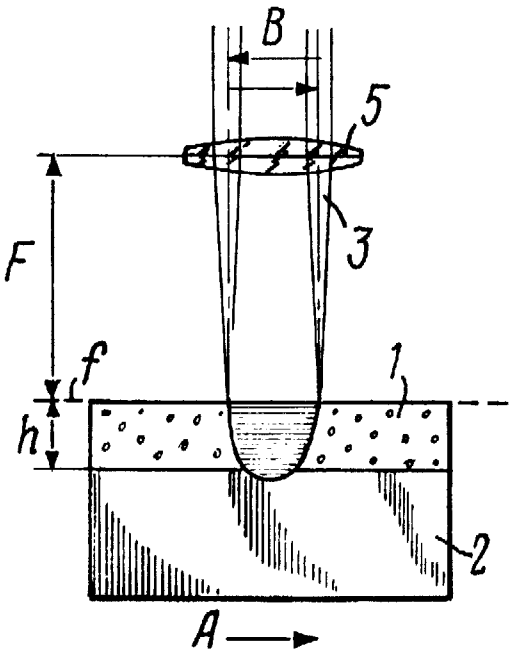
FIG. 6 shows diagrammatically laser treatment of the strengthening coating layer (the focal plane coinciding with the surface of said coating layer), according to the method of the invention.

The treatment of the layer 1 (FIG. 5) of the strengthening coating can be effected with a scanning focused laser beam 3. This increases substantially the area of the laser action and levels out the energy distribution over the surface being treated. The scanning frequency of the laser beam 3 should be set equal to at least 40 Hz. If the scanning frequency is brought down below 40 Hz, the rate of treating the surface of the layer 1 of the coating must be reduced to achieve uniform fusion of the layer 1 of the coating; this leads to overheating of the strengthening coating, to a higher level of residual stresses in said coating, and, as a consequence, to peeling thereof. The scanning amplitude C of the laser beam 3 should be chosen according to the shape and physical dimensions of the surface 2 of the machine part together with the layer 1 of the strengthening coating and be equal to at least half the diameter d of said beam 3, since scanning of the beam 3 with a smaller amplitude C will fail to achieve uniform energy distribution in the zone 4 of the laser action, with all the negative repercussions.

Scanning of the laser beam 3 over the surface of the layer 1 of the coating can be effected along a line or over a planar geometrical figure; this ensures uniform energy distribution in the zone of laser action.

Figure 9:
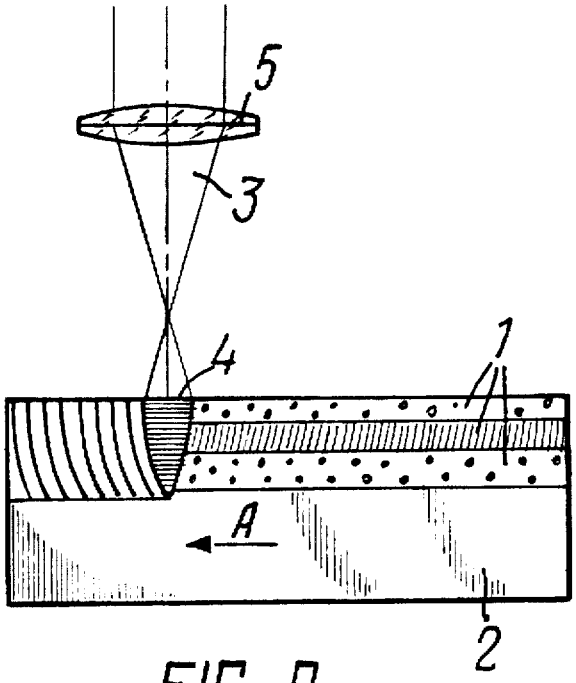
FIG. 9 shows diagrammatically laser treatment of all the strengthening coating layers simultaneously, according to the method of the invention.

The strengthening coating, prior to the laser treatment, can be applied in several layers (FIG. 9) of homogeneous and/or heterogeneous metals or metal-containing materials; this makes it possible to obtain special prescribed properties on the surface.

Each applied layer 1 of the strengthening coating can be treated successively with the laser beam 3; this makes it possible to increase the strength of adhesion between the layers 1 of the strengthening coating and to obtain a thicker coating.

Figure 10:
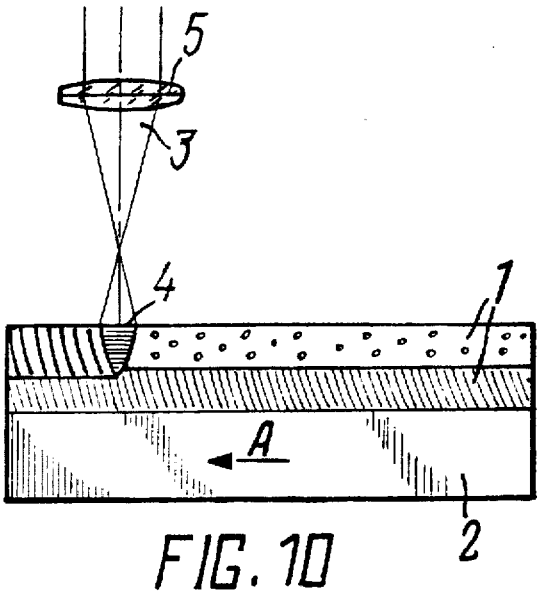
FIG. 10 shows diagrammatically laser treatment of the next strengthening coating layer applied to the preceding coating layer already fused with the laser beam, according to the method of the invention.

In another embodiment of the invention all the applied layers 1 (FIG. 10) can be treated with the laser beam 3 simultaneously. This makes it possible to increase the strength of adhesion of the layers 1 of the coating with each other and with the surface 2 of the machine part, as well as to obtain definite prescribed properties on said surface 2.

The invention will now be described with reference to specific examples illustrating embodiments thereof according to the herein-proposed method.

EXAMPLE 1 (FIG. 6)

To increase the wear-resistance of a machine part, say, of a cam, manufactured from a high-strength steel, a layer 1 of a self-fluxing strengthening coating based on nickel, chromium, boron, and silicon (Ni—Cr—B—Si) was applied to the surface 2 of the machine part. The surface 2 of the machine part was activated by blasting with synthetic corundum. The layer 1 of the strengthening coating was deposited by plasma-spraying. Then the surface of the layer 1 of the coating was fused with a scanning focused laser beam 3 with a diameter of 0.2 mm, a power of 1.0 kW, with the rate of travel of the surface 2 of the machine part being treated equal to 50 mm/min. The focal plane f coincided with the zone 4 of treatment of the strengthening coating 1. Fusion of the layer 1 of the coating was effected throughout its thickness h equal to 0.3 mm; the time of interaction of the laser beam 3 with the surface of the layer 1 of the strengthening coating was 6.6×10 s. The scanning frequency v of the laser beam was 40 Hz, the amplitude C of the laser beam scanning was equal to 5 mm.

Tests of the strengthened machine part for wear-resistance showed an approximately threefold increase in the wear-resistance thereof.

The results were confirmed by tests for wear-resistance performed by following the commonly adopted procedure according to the Russian State Standard.

EXAMPLE 2 (FIG. 7)

To restore machine parts, e.g., cylinders of a hydraulic system, manufactured from a high-strength steel, whose surface was damaged by electrochemical corrosion to a depth of 0.5 mm, the surface 2 of the machine part was activated by blasting with synthetic corundum, followed by treatment with acetone. Then a layer 1 of strengthening plasma-sprayed coating based on nickel, chromium, boron, and silicon (Ni—Cr—B—Si) was applied to the surface 2 of the machine part. To reduce the porosity of the surface of the layer 1 of the strengthening coating, it was treated with a scanning focused laser beam 3 with a diameter of 0.2 mm, a power of 1.5 kW, the rate of travel of the surface under treatment being 200 mm/min. The focal plane f of focusing element 5 was at a distance of 10 mm from the zone 4 of treatment, below the surface of the layer 1 of the strengthening coating. Fusion of the layer 1 of the coating was effected to the depth of 0.1 mm; the time of interaction of the laser beam 3 with the layer 1 of the coating was 2×10 s. The scanning frequency v of the laser beam 3 was 40 Hz, the amplitude C of scanning of the laser beam 3 was equal to 5 mm. The process operations performed in accordance with the method of the invention resulted in restoring the physical dimensions of the machine part and also increased substantially the corrosion resistance thereof. Tests for corrosion resistance were performed by following a conventional express procedure under the salt mist conditions. The presence of corrosion injuries was not found, so that the service life of the cylinders could be extended appreciably.

EXAMPLE 3 (FIG. 8)

To restore surface 2 of machine parts, e.g., cylinders of a shock absorber, manufactured from a high-strength steel, subjected to impact loads and having injuries in the form of dents, the surface 2 of the machine part was activated by blasting with synthetic corundum. Then layer 1 of a self-fluxing coating based on nickel, chromium, boron, and silicon (Ni—Cr—B—Si) was applied to the surface 2, and after that fusion was effected using a focused laser beam 3 with a diameter of 3.5 mm, a power of 1.5 kW, at a rate of travel of the surface being treated equal to 600 mm/min. The focal plane f of focusing element 5 was at the distance of 15 mm from the zone 4 of treatment, above the surface of the strengthening coating 1. Fusion of the coating 1 was effected with sub-fusion of the surface 2 of the machine part to the depth of 0.1 mm; the time of interaction of the laser beam 3 with the surface of the coating 1 was 7.3×10 s. Then a second layer, 0.5 mm thick, was applied and fused with a focused laser beam under the above-stated conditions, and thereafter a third 0.5 mm thick layer was applied and also fused under similar conditions. The application of several layers of the strengthening coating in succession made it possible to preclude weakening of the previously heat-treated surface of the machine part, to restore the physical dimensions of said part, and to achieve a twofold increase in the wear-resistance of the surface. The performed operations resulted in complete restoration of the physical dimensions of the machine part; the service life thereof increased more than twofold.

EXAMPLE 4 (FIG. 7)

To restore machine parts, e.g., rings of an aircraft nozzle assembly, manufactured from heat-resistant nickel alloys, having wear injuries at temperatures above 800° C., surface 2 of the machine part was activated by blasting with synthetic corundum. Then layer 1 of a 2 mm thick high-temperature coating based on nickel and chromium was applied to said surface 2 by plasma spraying, and after that the layer 1 of the high-temperature coating was fused over the periphery of the machine parts to increase its adhesion strength under the conditions of sliding friction. The diameter d of the focused scanning laser beam was chosen to be 3–4 mm; the power was 5 kW; the rate of travel of the surface under treatment was 600 mm/min. The focal plane f was at the distance of 5 mm from the zone 4 of treatment, below the surface of the strengthening coating 1; the frequency v of scanning of the laser beam was 200 Hz; the amplitude C of scanning was 4 mm. The operations performed in accordance with the method of the present invention resulted in complete restoring of the physical dimensions of the machine parts; their wear-resistance and high-temperature strength became increased. These results are confirmed by bench tests of strengthening coatings under conditions close to the field ones. The service life of the machine parts increased by more than 3 times.

EXAMPLE 5 (FIG. 6)

To restore machine parts, e.g., compressor blades, manufactured from high-strength titanium alloys, having 0.5 mm deep wear injuries resulting from sliding friction, surface 2 of the machine part was activated by blasting with synthetic corundum. Then a strengthening nickel coating was applied to the surface 2 of the machine part by detonation, and after that said coating 1 was fused with a focused scanning laser beam 3 with a diameter of 5 mm, power of 4 kW, the rate of travel of the surface under treatment being 300 mm/min, the frequency of scanning v being 200 Hz, the amplitude C of scanning being 8 mm, the scanning being effected along a line. The focal plane f of focusing element 5 was on the surface 2 of the strengthening coating 1. The process operations carried out in accordance with the method of the present invention resulted in complete restoring of the physical dimensions of the compressor blades and in an approximately sixfold increase of the wear-resistance thereof. The results of improvements in the operability of the blades were confirmed by the tests of samples for wear-resistance and by bench tests of the blades.

EXAMPLE 6 (FIG. 9)

To restore the surface of a cam manufactured from a high-strength steel for 2 mm, a first 1 mm thick strengthening coating layer was applied to the machine part surface by following the technology described in Example 1. After laser treatment of said layer 1, another 1 mm thick strengthening coating layer 1 was applied thereto by following the same technology; said second layer 1 was fused with a laser beam 3 in accordance with the technology described in Example 1. As a result of the performed operations, the surface of the machine part was restored completely for the thickness of 2 mm.

EXAMPLE 7 (FIG. 10)

To restore the landing gear shaft of a flight vehicle, the shaft surface was activated by sand blasting, then a first 0.1 mm thick strengthening coating layer 1 based on nickel aluminide (NiAl) was applied by flame spraying to the thus prepared surface 2. After that, a next layer 1 of bronze, 0.6 mm thick, was applied using the same method. The resulting multilayer coating was fused simultaneously with a scanning focused laser beam 3 of 0.2 mm in diameter, with a power of 2.5 kW, the rate of travel of the surface under treatment being 600 mm/min. The focal plane f of focusing element 5 was at the distance of 5 mm from the zone 4 of treatment, below the surface of the strengthening coating 1. Fusion of the coating layer 1 was effected to the depth of 0.8 mm, the time of interaction of the laser beam 3 with the coating layer was 2×10 s. The scanning frequency v of the laser beam 3 was 150 Hz, the scanning amplitude C of the laser beam 3 was equal to 3 mm. The sequence of operations performed in accordance with the method of the present invention resulted in complete restoring of the landing gear shaft, with a threefold to sixfold increase in the wear-resistance thereof.

EXAMPLE 8

To increase the height of turbine blades manufactured from a high-temperature alloy by 0.3 mm with a view to changing the design and enhancing the wear-resistance thereof, their surface 2 was activated by blasting with synthetic corundum. Then a strengthening coating 1 based on nickel and chromium was applied to the surface 2 of the machine part by detonation, and said coating 1 was fused by using a focused scanning laser beam 3 with a diameter of 0.2 mm and power of 0.5 kW. The rate of travel of the surface under treatment was 50 mm/min, the scanning frequency v was 40 Hz, the scanning amplitude C was 3 mm. Scanning was effected along a line, the focal plane f of focusing element 5 was on the surface 2 of the strengthening coating 1. The result of the sequence of operations performed in accordance with the method of the present invention was a 0.3 mm increase in the height of the blades and an approximately threefold increase in the wear-resistance thereof. This fact was confirmed by bench tests.

The above-cited and other specific Examples illustrating the embodiments of the method of applying strengthening coatings according to the present invention are summarized in the Table hereinbelow.

TABLE

| Nos. | Technological parameters of laser treatment | Examples 1 | 2 | 3 | 4 | 5 |
|---|---|---|---|---|---|---|
| 1. | Laser beam power, kW | 1.0 | 1.0 | 1.5 | 5.0 | 3.0 |
| 2. | Beam diameter in treatment zone, mm | 0.2 | 0.2 | 3.5 | 2.5 | 2.5 |
| 3. | Rate of travel of the surface being treated, mm | 50 | 200 | 600 | 800 | 300 |
| 4. | Distance from the focal plane to the surface being treated (+ above the surface; − below the surface) | 0 | −10 | +15 | −5 | 0 |
| 5. | Time of interaction of the laser beam with the coating surface, × 10 | 6.6 | 2 | 7.3 | 0.2 | 49 |
| 6. | Scanning frequency, Hz | 40 | 40 | — | 200 | 150 |
| 7. | Scanning amplitude, mm | 5.0 | 3.0 | — | 4.0 | 8.0 |
| 8. | Number of layers in the coating | 1 | 1 | 3 | 1 | 1 |
| 9. | Number of simultaneously treated layers | 1 | 1 | 1 | 1 | 1 |
| 10. | Total thickness of the coating, mm | 1.0 | 0.8 | 1.0 | 2.0 | 0.5 |
| 11. | Depth of layer treatment, mm | 0.8 | 0.3 | 1.1 | 2.2 | 0.6 |
| 12. | Type of laser fusion | complete | partial | complete with the main surf. | over the periphery | complete with the main surt. |

| Nos. | Technological parameters of laser treatment | Examples 6 | 7 | 8 | 9 | 10 |
|---|---|---|---|---|---|---|
| 1. | Laser beam power, kW | 1.0 | 2.5 | 0.5 | 10.0 | 2.0 |
| 2. | Beam diameter in treatment zone, mm | 0.2 | 0.2 | 0.2 | 8.0 | 1.5 |
| 3. | Rate of travel of the surface being treated, mm | 50 | 600 | 50 | 2000 | 600 |
| 4. | Distance from the focal plane to the surface being treated (+ above the surface; − below the surface) | 0 | −5 | 0 | −25 | 0 |
| 5. | Time of interaction of the laser beam with the coating surface, × 10 | 6.6 | 2 | 24 | 27 | 2.5 |
| 6 | Scanning | 40 | 150 | 40 | – | 100 |

TABLE-continued

| | | | | | | |
|---|---|---|---|---|---|---|
| | frequency, Hz | | | | | |
| 7. | Scanning amplitude, mm | 5.0 | 3.0 | 3.0 | – | 10 |
| 8. | Number of layers in the coating | 2 | 2 | 1 | 1 | 1 |
| 9. | Number of simultaneously treated layers | 1 | 2 | 1 | 1 | 1 |
| 10. | Total thickness of the coating, mm | 2.0 | 0.7 | 0.3 | 4.0 | 2.0 |
| 11. | Depth of layer treatment, mm | 1.0 | 0.8 | 0.4 | 4.5 | 0.3 |
| 12. | Type of laser fusion | complete | complete | complete | along and across | partial over the thickness |

Industrial Applicability

The present method of applying strengthening coatings on metallic or metal-containing surfaces can be used in the manufacturing and restoring of machines and mechanisms operating under particularly complicated conditions: elevated loads, vibration, high temperatures, in the presence of aggressive corrosive media, and also in those cases, when in the manufacturing and restoring it is necessary to preclude the appearance of or eliminate the already existing surface injuries, and to improve the service characteristics, such as wear-resistance, corrosion-resistance, heat-resistance, high-temperature-resistance, etc. The herein-proposed invention can find extensive application in the aircraft industry, engine building, automotive engineering machine-tool engineering, in the manufacture and restoration of precision machinery and mechanisms.

When strengthening coatings are applied, e.g., to the component parts of hydraulic cylinders of aircraft, subject to electrochemical corrosion and operating under high loads, use can be made of laser treatment of plasma-sprayed coatings. Such laser treatment enables an increase in the corrosion-resistance of the plasma-sprayed coatings and in their adhesion with the machine part surface.

In the strengthening and restoration of, e.g., compressor blades employed in aircraft engines, manufactured from titanium alloys having a low wear-resistance, strengthening coating is applied thereto by detonation, with subsequent laser fusion thereof according to the method of the present invention. As a result of strengthening the end faces of the blades, the working parameters of the engine, e.g., its thrust and the like, are improved severalfold.

Strengthening of guides in the manufacture of precision machine tools is achieved, according to the method of the present invention, by applying strengthening plasma-sprayed coatings, followed by laser fusion thereof. This enables a two- and threefold increase in the wear-resistance and service life of the machine tool.

The herein-proposed method of applying strengthening coatings to metallic or metal-containing surfaces makes it possible to improve substantially the performance characteristics of strengthening coatings employed in the manufacturing and restoring of the components of machines and mechanisms operating under the conditions of elevated loads, velocities, vibrations, high temperatures, in the presence of corrosive media, etc.

The use of the herein-proposed method enables an appreciable increase in such efficiency characteristics of strengthening coatings as:

wear-resistance, corrosion-resistance, adhesion strength, etc.

The invention proposed herein provides a possibility for achieving connection between heterogeneous materials, such as nickel and titanium, etc., without impairing the structure of the main material from which the machine part is manufactured.

The present invention can be extensively used in the aircraft industry, engine building, automotive engineering, machine-tool engineering, as well as in the manufacture of other machines and mechanisms, the result being an essential increase in their service life and dependability.

We claim:

1. A method of applying a strengthening coating layer to a metallic or metal-containing surface, said method comprising the following sequence of operations:

activation of the metallic or metal-containing surface to which said strengthening coating layer is to be applied;

application of said strengthening coating layer to said activated surface;

treatment of said applied strengthening coating layer with a laser beam focused using a focusing element, said laser beam where it contacts said strengthening layer having a diameter of from approximately 0.2 mm to approximately half the diameter of said laser beam prior to the focusing thereof; the power of said laser beam being at least 0.5 kW; the distance from the focal plane of said focusing element to the surface of said applied layer being less than or equal to half the focal distance of said focusing element; and the rate of relative travel of said surface of the applied layer and of said focused laser beam being at least 50 mm/min.

2. A method as claimed in claim 1, wherein said treatment of said strengthening coating layer applied to the metallic or metal-containing surface is continued until there is complete fusion of said layer through the thickness thereof.

3. A method as claimed in claim 1, wherein said treatment of said strengthening coating layer applied to the metallic or metal-containing surface is continued until there is partial fusion thereof.

4. A method as claimed in claim 1, wherein the time of interaction of said focused laser beam with said strengthening coating layer applied to the metallic or metal-containing surface at each point of said layer is set to be within the range of from about 0.3 to about 0.8 of the time of interaction of said focused laser beam with said strengthening coating layer needed to cause fusion thereof at each point thereof over the thickness thereof.

5. A method as claimed in claim 1, wherein said treatment of the strengthening coating layer applied to the metallic or metal-containing surface is continued until there is sub-fusion of the surface to which said layer is applied.

6. A method as claimed in claim 1, wherein the time of interaction of said focused laser beam with said strengthening coating layer applied to the metallic or metal-containing surface at each point of said layer is set to be equal to at least 1.1 of the time of interaction of said focused laser beam with said strengthening coating layer at each point thereof needed to cause complete fusion of said layer over the thickness thereof.

7. A method as claimed in claim 1, wherein said strengthening coating layer has a surface opposite its engagement with the metallic or metal-containing surface, said treatment of the strengthening coating layer applied to the metallic or metal-containing surface, is effected over at least a portion of the surface of said layer.

8. A method as claimed in claim 7, wherein said treatment of the strengthening coating layer applied to the metallic or metal-containing surface is effected over the periphery of the surface of said layer.

9. A method as claimed in claim 7, wherein said treatment of the strengthening coating layer applied to the metallic or metal-containing surface is effected along and/or across the surface thereof.

10. A method as claimed in claim 7, wherein said treatment of the strengthening coating layer applied to the metallic or metal-containing surface is effected with a scanning focused laser beam.

11. A method as claimed in claim 10, wherein the frequency of said scanning with the focused laser beam over the surface of said strengthening coating layer applied to the metallic or metal-containing surface is at least 40 Hz.

12. A method as claimed in claim 10, according to which the amplitude of said scanning with the focused laser beam over the surface of said strengthening coating layer applied to the metallic or metal-containing surface is selected based on the shape and physical dimensions of the surface with said strengthening coating layer applied thereto.

13. A method as claimed in claim 10, wherein said scanning with said laser beam over the surface of said strengthening coating layer applied to the metallic or metal-containing surface is effected either along a line or along a planar geometrical figure.

14. A method as claimed in claim 1, wherein a plurality of strengthening layers are applied one atop the other to the metallic or metal-containing surface of the machine part.

15. A method as claimed in claim 14, wherein each strengthening coating layer is of a metallic or metal-containing material.

16. A method as claimed in claim 14, wherein a first one of said strengthening coating layers is applied to the metallic or metal-containing surface alone, said applied layer is then treated with said focused laser beam, a second one of said strengthening coating layers is then applied over the processed first strengthening coating layer, and said second layer is treated again with the focused laser beam; and said sequence of operations is repeated until all the strengthening coating layers are applied to the metallic or metal-containing surface.

17. A method as claimed in claim 14, wherein all said strengthening coating layers are applied one after another in succession to the metallic or metal-containing surface, whereafter all the applied strengthening coating layers are treated simultaneously with the focused laser beam.

18. The method according to claim 1, and further comprising the step of:

applying a second strengthening coating layer over said first strengthening layer; and treating said second strengthening layer with said focused laser beam.

19. The method according to claim 18, and further comprising:

applying a third strengthening layer over said second strengthening layer, and treating at least two of said layers with said focused laser beam.

20. The method according to claim 1, wherein said applied strengthening layer is applied in a substantially uniform thickness to said activated surface.

* * * * *